United States Patent [19]

Hampton

[11] 4,153,015

[45] May 8, 1979

[54] CARBURETOR ADAPTER FOR MULTICYLINDER ENGINES AND MANIFOLD THEREFOR

[76] Inventor: Dennis Hampton, 4424 La Mirada Cir., Fair Oaks, Calif. 95628

[21] Appl. No.: 600,519

[22] Filed: Jul. 30, 1975

[51] Int. Cl.[2] ..... F02B 75/18

[52] U.S. Cl. ..... 123/52 M; 123/52 MV; 123/59 PC; 261/65

[58] Field of Search ..... 123/59 PC, 127, 52 M, 123/52 MU, 73 A; 261/65, 23 A

[56] References Cited

U.S. PATENT DOCUMENTS

| | | | |
|---|---|---|---|
| 1,133,528 | 3/1915 | Bennett | 123/52 M |
| 2,444,665 | 7/1948 | Oberbeck | 123/59 PC |
| 2,536,716 | 1/1951 | Bonser | 123/127 |
| 2,573,095 | 10/1951 | Ellis | 123/59 PC |
| 3,370,575 | 2/1968 | Soubis | 123/52 M |
| 3,563,220 | 2/1971 | Garner | 123/127 |
| 3,983,853 | 10/1976 | Gospodar | 123/52 M |

FOREIGN PATENT DOCUMENTS

| | | | |
|---|---|---|---|
| 306270 | 3/1933 | Italy | 123/52 M |
| 935882 | 9/1963 | United Kingdom | 123/52 M |

*Primary Examiner*—Ronald H. Lazarus
*Attorney, Agent, or Firm*—Edwin E. Greigg

[57] ABSTRACT

Disclosed is a manifold and carburetor system especially for motorcycles having a plurality of cylinders so that each cylinder can be assured of uniform fuel input. Balancing means in the manifold uniformly distributes a fuel charge to the plural cylinders, and a choice of carburetor adapter plates provides flexibility in the selection of carburetors to accommodate a variety of driving conditions.

5 Claims, 10 Drawing Figures

FIG. 1
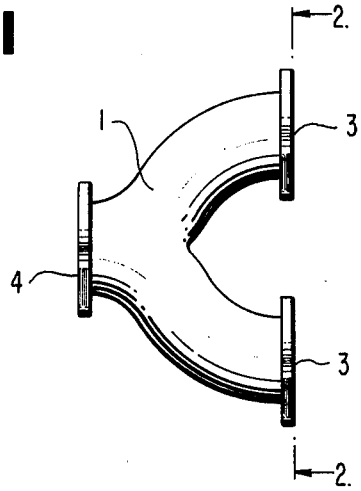
FIG. 2
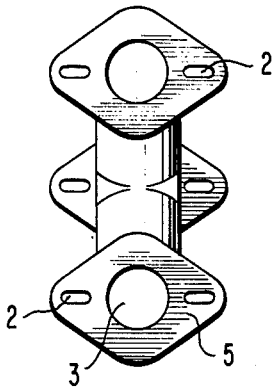
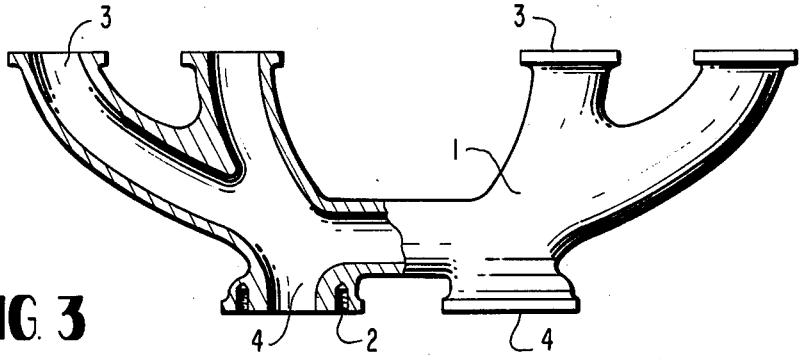
FIG. 3
FIG. 4
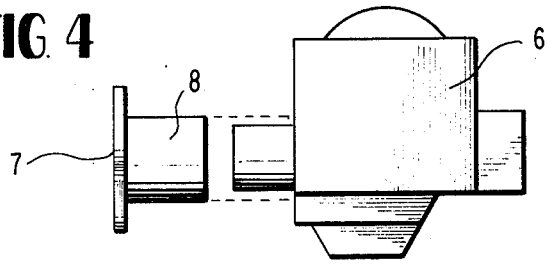

FIG. 8
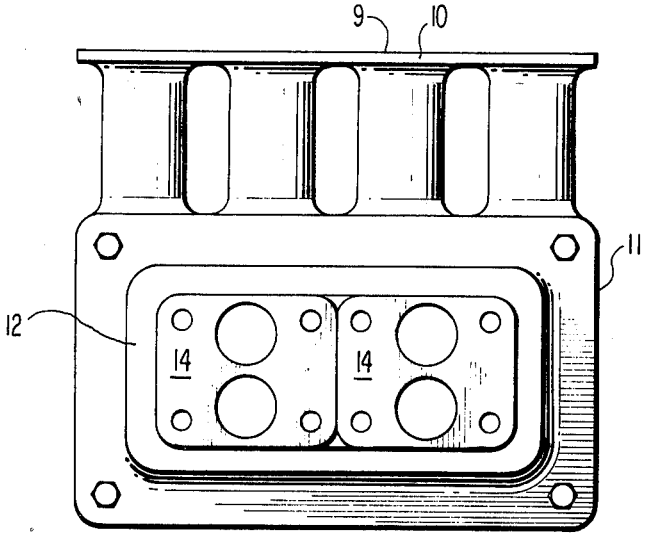
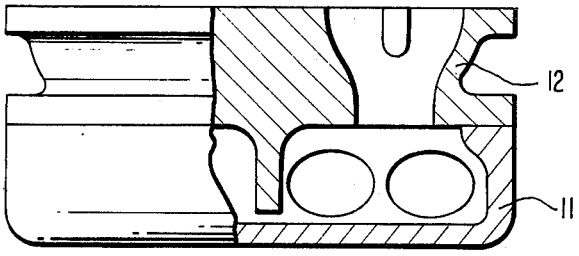
FIG. 9
FIG. 10
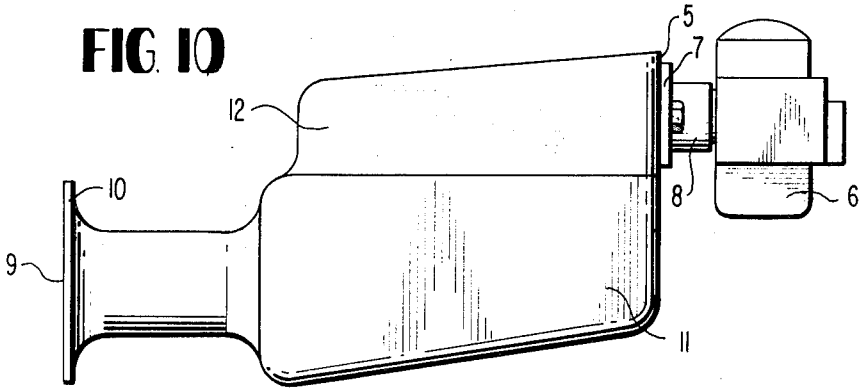

CARBURETOR ADAPTER FOR MULTICYLINDER ENGINES AND MANIFOLD THEREFOR

BACKGROUND OF THE INVENTION

1. Field of the Invention

This invention relates generally to adapting structures to provide flexibility in carburetor selection.

Today's high performance engines, particularly on motorcycles, have enjoyed increased performance especially by using a single carburetor and manifold for each cylinder. However, such a system is difficult to maintain at peak efficiency without specialized tuning equipment because atmospheric and weather changes as well as driving impose conditions in which fuel-air ratio requirements and therefore idle settings frequently change as a function of time and use. The problem is compounded further when one of a series of independent carburetors is adjusted to correct, for example, a lean mixture or inadequate idle speed, the adjustment frequently imbalances that cylinder relative to the others. A tedious, iterative process results in which the remaining carburetors are adjusted to restore this balance, but it is readily understood that each time one cylinder's fuel and idle requirements are satisfied, it may reveal an inadequacy in the adjustment in any of the other cylinders, since the cylinders all must cooperate equally to assure smooth idling and balanced acceleration.

2. Description of the Prior Art

Devices for modifying carburetors have existed for some time. Pierce in U.S. Pat. Nos. 3,678,962 and Lohn Re. 27,378 both disclose carburetor manifold adapters which allow a four-barrel carburetor to be placed on various intake manifolds. Although they may simplify tune-up procedures they are limited, however, by the existing manifold and consequently do not enjoy the flexibility of the present system. They are capable of increasing or more uniformly introducing the fuel-air mixture but they do so by increasing the carburetion and are thereby restrictive in carburetor options.

OBJECTS AND SUMMARY OF THE INVENTION

Accordingly, it is an object of this invention to provide a system which is capable of accurate carburetor synchronization without the need for highly specialized equipment or tedious labor.

Additionally, it is a further object of this invention to provide a system whose flexibility is such that one may modify his motorcycle carburetion to fit his driving needs.

The adapter system described hereinbelow provides that flexibility to allow one to improve fuel economy, performance and maintenance requirements.

Further objects and advantages will become apparent from a reading of the following detailed specification taken in conjunction with the drawings.

BRIEF DESCRIPTION OF THE DRAWING

FIG. 1 shows a manifold top plan view in which a Y adapter allows one duct to communicate with two passages;

FIG. 2 shows an end view of FIG. 1, taken along lines 2—2 of FIG. 1;

FIG. 3 depicts partially in section and partially in elevation a manifold arrangement for dividing two input channels into four outlet passages.

FIG. 4 generally shows in elevation the mounting details for installing a carburetor to an inlet passage;

FIG. 8 shows a top-plan view of a two carburetor adapter;

FIG. 9 shows a cutaway side view of the manifold adapter combination depicted in FIG. 8;

FIG. 10 shows a further alternate embodiment for the adapter illustrated in FIG. 6.

DESCRIPTION OF THE PREFERRED EMBODIMENTS

Figure 6:
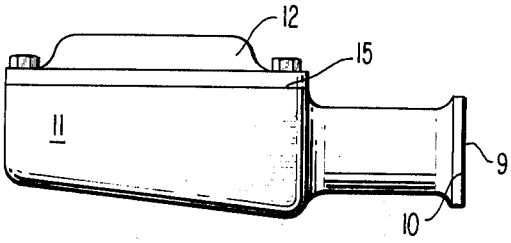
FIG. 6 shows a side elevational view of FIG. 5 with the addition of a manifold adapter.

FIGS. 1 and 2 depict a Y-shaped adapter manifold which has a main body 1 generally regarded as a conduit network provided with two orifices denoted at 3 which are provided on one side of the adapter and are arranged to communicate with a single orifice denoted at 4 which is oppositely disposed. In this embodiment of the invention 3—3 indicate the carburetor mounting area while the portion denoted as 4 indicates the surface upon which the manifold adapter is secured to the engine. The flanged area 5 of the inlet side has notches 2 disposed thereon so that there is greater flexibility in mounting the carburetor than would be possible with the conventional circular hole arrangement.

The system depicted above is suitable for increasing the total number of carburetors on an engine having one cylinder, however, it is also possible to reverse the system so that if one had a two-cylinder motorcycle the orifices 3 could be mounted on the engine and the area 4 would be used to mount a single carburetor thereon.

FIG. 3 denotes an alternative embodiment in which four inlet branches are collected in the manifold adapter and caused to exit into two outlets. It is important to note that each branch of these inlet tubes communicate with one another to thereby provide a greater likelihood of charge uniformity so that when the air and gas mixture reaches the outlet area 4 the quantum of the charge is standardized and uniform. This arrangement as discussed is compatible with a two-cylinder motorcycle in which one desires to mount four carburetors. However, as in FIGS. 1 and 2 the system can be reversed so that an engine with four cylinders can be accommodated by two carburetors by merely reversing this manifold adapter.

FIG. 4 shows the structural details for a motorcycle carburetor generally denoted at 6 which an engine mount denoted at 7 and 8 to be placed thereon. Sleeve 8 snugly fits over the outlet orifice of the motorcycle carburetor and in conjunction with flanged surface 7 is suitably fashioned to install same on the inlet portals depicted in FIGS. 2 and 3.

Figure 5:
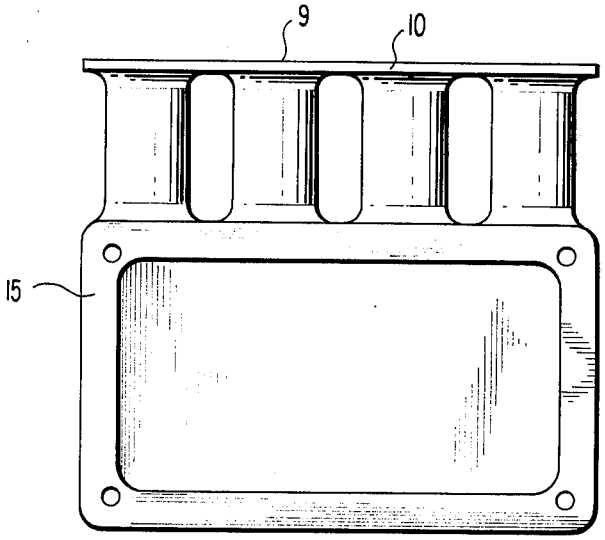
FIG. 5 shows in top plan another embodiment of the invention in which the induction tubes emanate from a common carburetion collector.
Figure 7:
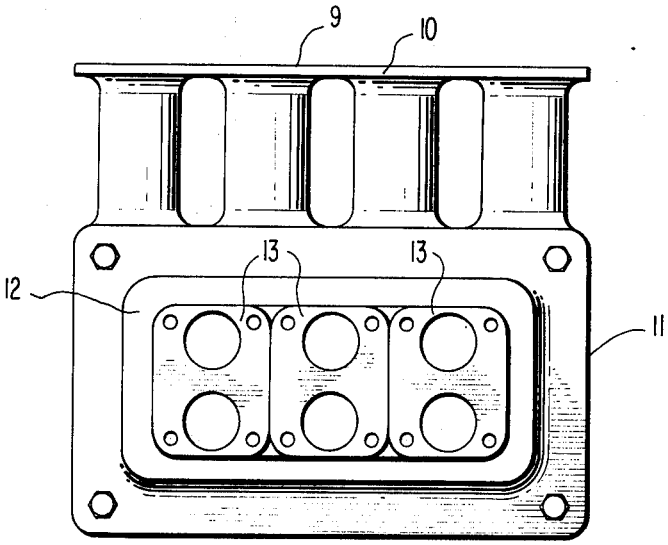
FIG. 7 shows a top plan view of a three carburetor adapter.

FIGS. 5 and 6 show a carburetor adapter system specifically designed for a four-cylinder motorcycle, FIG. 5 being shown without adapter 12. Outlet orifice 9 of manifold 11 is provided with a flanged surface 10 to provide a good mating surface with the engine. The top surface 15 of manifold 11 has an inlet orifice area which is fashioned to accommodate a variety of different manifold adapter plates. The manifold adapter 12 provides a nesting surface for these plates and is fastened to the manifold. Different varieties of these plates however are seen in both FIGS. 7 and 8. FIG. 7 for example shows a three-carburetor manifold adapter plate 13 in which the four-cylinder engine is supplied with three carburetors each having two barrels. FIG. 8 shows a similar system in which the manifold adapter 12 is provided with plates 14 which will accommodate two two-barrel carburetors. As shown in FIGS. 7 and 8 once an interested individual has the manifold adapter 12, he can, by merely selecting either of the appropriate adapter plates 13 and 14 shown in FIGS. 7 and 8, respectively, modify the carburetor set-up in a plurality of ways and thereby tailor carburetion to the type of driving he prefers.

FIG. 9 generally shows a cutaway side view of the embodiment depicted in FIG. 8 wherein the two inlet orifices combine in the adapter manifold area to form a generally Y-shaped area and thereafter is arranged to feed two outlet orifices of the manifold which goes directly to the engine. This is important to assure charge uniformity, and would be especially economical if one had a pair of two-barrel carburetors he wished to retain. In this embodiment the adapter plates are integral with the adapter 12 and extend downwardly to form channels.

In the embodiments discussed in FIGS. 5–9 it will be appreciated that the carburetor or carburetors are placed directly on top of the manifold adapter. However, there are situations in which the clearances especially on a motorcycle are such that there is not enough room to have the carburetors disposed directly on top of the adapter. Accordingly, FIG. 10 shows an alternative arrangement in which the carburetor 6 communicates with the manifold 11 via the manifold adapter 12 by having side inlet branches disposed on the adapter rather than providing them on its upper surface. This more closely corresponds to the mounting arrangement which has been depicted in FIGS. 1, 2 and 3, since these added components do not increase the thickness of the manifold assembly as in FIG. 6. Additionally, adapter plates as seen in FIGS. 7 and 8 are disposed between the carburetor and adapter.

In operation one who is more concerned about reliability and fuel economy over pure performance would be more likely to use an adapter set-up in which a plurality of carburetors would be substantially reduced so that problems with synchronization would be minimized. However, if he were concerned with optimum performance he would choose an arrangement which would maximize the number of carburetors thereby assuring an optimum gas flow rate, and using the embodiment where all inlet chambers are allowed to communicate with each other he would be assured of having a flow rate which would be adequate for the demands created on the motorcycle, and further be assured that the charge input for each cylinder would be equalized.

I claim:

1. A carburetor engine manifold adapter system comprising an adapter having:

a conduit portion defining a common area;

at least three further conduit portions connected to and extending from the conduit portion defining the common area to define thereby at least three passages relative to the common area;

said further conduits defining at their ends remote from the common area, a flanged opening each of substantially similar dimension in terms of the opening and the flange; and said system including at least one sleeve having a body portion terminating in a flanged opening having a substantially similar dimension in terms of the opening and flange as the ends of said adapter so as to be fastened thereto, and wherein said body portion of said sleeve is of a dimension to snugly receive a corresponding part of a carburetor positioned thereon so that the carburetor is fastened to said adapter by said sleeve.

2. The adapter system as defined in claim 1, having three further conduit portions, with two of the further conduit portions extending from the conduit portion defining the common area in a direction substantially opposite to the other of the further conduit portions.

3. The adapter system as defined in claim 1, having six further conduit portions, with four of the further conduit portions extending from the conduit portion defining the common area in a direction substantially opposite to the other two further conduit portions, with the four further conduit portions being divided into two groups, and with the further conduit portions of each group merging together downstream of their respective flanged openings and upstream of the conduit portion defining the common area.

4. The adapter system as defined in claim 1, wherein the flanged openings serve as inlet means and outlet means, and wherein there are fewer inlet means than outlet means.

5. The adapter system as defined in claim 1, wherein the flanged openings serve as inlet means and outlet means, and wherein there are fewer outlet means than inlet means.

* * * * *